US009803915B2

(12) United States Patent
Park et al.

(10) Patent No.: US 9,803,915 B2
(45) Date of Patent: Oct. 31, 2017

(54) REFRIGERATOR

(71) Applicant: LG ELECTRONICS INC., Seoul (KR)

(72) Inventors: Junsoo Park, Seoul (KR); Jiyeong Ku, Seoul (KR); Jiyoon Lee, Seoul (KR); Jiyoung Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/983,852

(22) Filed: Dec. 30, 2015

(65) Prior Publication Data

US 2016/0187052 A1 Jun. 30, 2016

(30) Foreign Application Priority Data

Dec. 31, 2014 (KR) ..... 10-2014-0195845

(51) Int. Cl.
*A47B 96/04* (2006.01)
*F25D 25/02* (2006.01)
*F25D 23/06* (2006.01)

(52) U.S. Cl.
CPC ..... *F25D 25/024* (2013.01); *F25D 23/062* (2013.01); *F25D 23/067* (2013.01); *F25D 2325/021* (2013.01)

(58) Field of Classification Search
CPC ..... F25D 25/027; F25D 25/024; F25D 25/02; F25D 23/062; F25D 23/04; F25D 2325/021; A47B 46/005; A47B 57/06; A47B 96/025; A47B 51/00
USPC ..... 312/408
See application file for complete search history.

(56) References Cited

U.S. PATENT DOCUMENTS 2,828,178 A * 3/1958 Dahlgren ..... F25D 23/04 312/321.5
4,217,010 A * 8/1980 Webb ..... F25D 11/02 312/312
4,500,147 A * 2/1985 Reister ..... F25D 23/025 312/291
6,220,684 B1 * 4/2001 Bent ..... A47B 96/02 211/88.01
8,100,488 B2 * 1/2012 Eisele ..... F25D 23/067 108/106

(Continued)

FOREIGN PATENT DOCUMENTS

JP 06-005591 2/1994
JP 2002-267350 9/2002

(Continued)

OTHER PUBLICATIONS

Partial European Search Report issued in European Application No. 15203159.7 dated May 31, 2016, 7 pages.

*Primary Examiner* — Daniel J Troy
*Assistant Examiner* — Timothy M Ayers
(74) *Attorney, Agent, or Firm* — Fish & Richardson P.C.

(57) ABSTRACT

A refrigerator includes a movable body that is located in a case that defines a storage compartment. The refrigerator further includes a shelf that is connected to the movable body via a connection member. The refrigerator further includes a guard that is configured to surround an edge of the shelf, that is larger than the shelf, and that includes a protrusion member that protrudes toward the movable body. The movable body includes a guide rail that is configured to guide the protrusion member during sliding.

18 Claims, 16 Drawing Sheets

(56) References Cited

U.S. PATENT DOCUMENTS

| | | | | |
|---|---|---|---|---|
| 8,182,056 | B2 * | 5/2012 | Gossens | A47B 88/12 312/408 |
| 8,297,726 | B2 * | 10/2012 | Ramm | A47B 51/00 312/408 |
| 8,740,322 | B2 * | 6/2014 | Moon | F25D 23/067 312/408 |
| 8,777,341 | B2 * | 7/2014 | Amaral | F25D 25/024 108/143 |
| 8,960,825 | B2 * | 2/2015 | Kwon | F25D 23/04 108/106 |
| 9,243,839 | B2 * | 1/2016 | Kim | F25D 25/024 |
| 2008/0067910 | A1 * | 3/2008 | Butler | A47B 96/02 312/408 |
| 2012/0091084 | A1 | 4/2012 | Amaral et al. | |
| 2016/0047594 | A1 * | 2/2016 | Choo | F25D 25/02 312/404 |

FOREIGN PATENT DOCUMENTS

| | | |
|---|---|---|
| JP | 2005-052603 | 3/2005 |
| KR | 10-2012-0115615 | 10/2012 |
| KR | 10-2013-0068554 | 6/2013 |

* cited by examiner

REFRIGERATOR

CROSS-REFERENCE TO RELATED APPLICATION

This application claims the priority benefit of Korean Patent Application No. 10-2014-0195845, filed on Dec. 31, 2014 in the Korean Intellectual Property Office, the disclosure of which is incorporated herein by reference.

FIELD

The present disclosure relates to a refrigerator.

BACKGROUND

In general, a refrigerator is an appliance that cools a storage compartment, such as a refrigerating compartment or a freezing compartment, using a refrigeration cycle circuit, which includes a compressor, a condenser, an expansion valve, and an evaporator, or a thermoelectric module, and stores articles, such as food, in the storage compartment, which is cooled as described above.

The refrigerator may include an inner case, which defines the storage compartment therein, and a door, which is configured to open and close to the storage compartment. A storage unit, such as a shelf, on which food is stored, or a drawer, in which food is stored, may be disposed in the storage compartment.

The refrigerator may further include a sliding guide configured to guide the sliding movement of the shelf in forward and rearward directions. The sliding guide may be mounted in the inner case.

SUMMARY

According to an innovative aspect of the subject matter described in this application, a refrigerator includes a movable body that is located in a case that defines a storage compartment; a shelf that is connected to the movable body via a connection member; and a guard that is configured to surround an edge of the shelf, that is larger than the shelf, and that includes a protrusion member that protrudes toward the movable body, where the movable body includes a guide rail that is configured to guide the protrusion member during sliding.

The refrigerator may include one or more of the following optional features. A front end part of the guard and a front end of the shelf define a gap. The refrigerator further includes another shelf that is located at a side of the shelf. The other shelf and the shelf define a gap that is configured to receive the guard. A side end of the shelf and the movable body define a gap that is configured to receive the guard. The guide rail extends in an inclined direction towards a front upper side of the refrigerator. The guide rail includes a plurality of guide rail parts that are spaced apart from each other towards a front of the refrigerator and towards a back of the refrigerator.

The protrusion member includes a plurality of protrusion member parts that are located at the guard and that are spaced apart from each other towards a front of the refrigerator and towards a back of the refrigerator. The plurality of guide rail parts includes two guide rail parts. The plurality of protrusion member parts includes two protrusion member parts. The refrigerator further includes a movable body guide that is located in the case and that is configured to guide the movable body during sliding towards a front of the refrigerator and towards a back of the refrigerator. A first contact area that is defined between the protrusion member and the guide rail is smaller than a second contact area that is defined between the movable body and the movable body guide.

According to another innovative aspect of the subject matter described in this application, a refrigerator includes a shelf that is configured to move and that is located in a case that defines a storage compartment; a guard that is configured to surround an edge of the shelf and that is larger than the shelf; and an interlocking mechanism that is connected to the shelf and the guard and that is configured to interlock a movement of the shelf towards a front of the refrigerator with a movement of the guard towards a top of the refrigerator.

The refrigerator may include one or more of the following optional features. The interlocking mechanism includes a first gear that is located at the shelf and that extends towards a front of the refrigerator and towards a back of the refrigerator; a second gear that is configured to engage the first gear; a third gear that is configured to engage the second gear; and a fourth gear that is configured to engage the third gear and that is connected to the guard. The fourth gear is a linear gear. The fourth gear is curved. The third gear is larger than the second gear.

The first gear is a linear gear. The refrigerator further includes a guide rail configured to guide at least one of the fourth gear or the guard. The refrigerator further includes a gear box that is located in the case and that defines a gear receiving space that is configured to receive the first gear, the second gear, the third gear, and the fourth gear. The second gear and the third gear are rotatably connected to at least one of the gear box or the case. The shelf and at least one of the gear box or the inner case define a gap that is configured to receive the guard. A front end part of the guard and a front end of the shelf define a gap. The refrigerator further includes another shelf that is located at a side of the shelf. The other shelf and the shelf define a gap that is configured to receive the guard.

It is an object of the subject matter described in this application to provide a refrigerator that is capable of maximally preventing articles, such as food, placed on a shelf from tipping over on the shelf or falling off the shelf during the movement of the shelf.

It is another object of the subject matter described in this application to provide a refrigerator that is capable of enabling a user to move a shelf forward and rearward and to move a guard upward and downward without limitation.

It is another object of the subject matter described in this application to provide a refrigerator having an aesthetically pleasing appearance and the maximum possible storage space even when a guard is provided in the refrigerator.

It is another object of the subject matter described in this application to provide a refrigerator configured such that, when a shelf is moved, a guard is disposed at a position corresponding to the shelf.

It is another object of the subject matter described in this application to provide a refrigerator configured such that the mobility and structural stability of a guard are simultaneously realized.

It is another object of the subject matter described in this application to provide a refrigerator configured such that the movement of a shelf is minimized when a user pulls or pushes a guard.

It is another object of the subject matter described in this application to provide a refrigerator configured such that, when one selected from between a shelf and a guard is moved, the other selected from between the shelf and the guard is moved automatically.

It is another object of the subject matter described in this application to provide a refrigerator configured such that a shelf and a guard are moved such that the shelf and the guard correspond to each other in terms of position.

It is another object of the subject matter described in this application to provide a refrigerator configured such that, when a user pulls a guard at an initial position of the guard, minimum force is required.

It is another object of the subject matter described in this application to provide a refrigerator configured such that the movement path of a guard is accurately maintained.

Throughout the drawings, "F" designates a front side, "R" designates a rear side, "U" designates a top side, "D" designates a bottom side, and "FU" designates a front top side.

DETAILED DESCRIPTION

Figure 1:
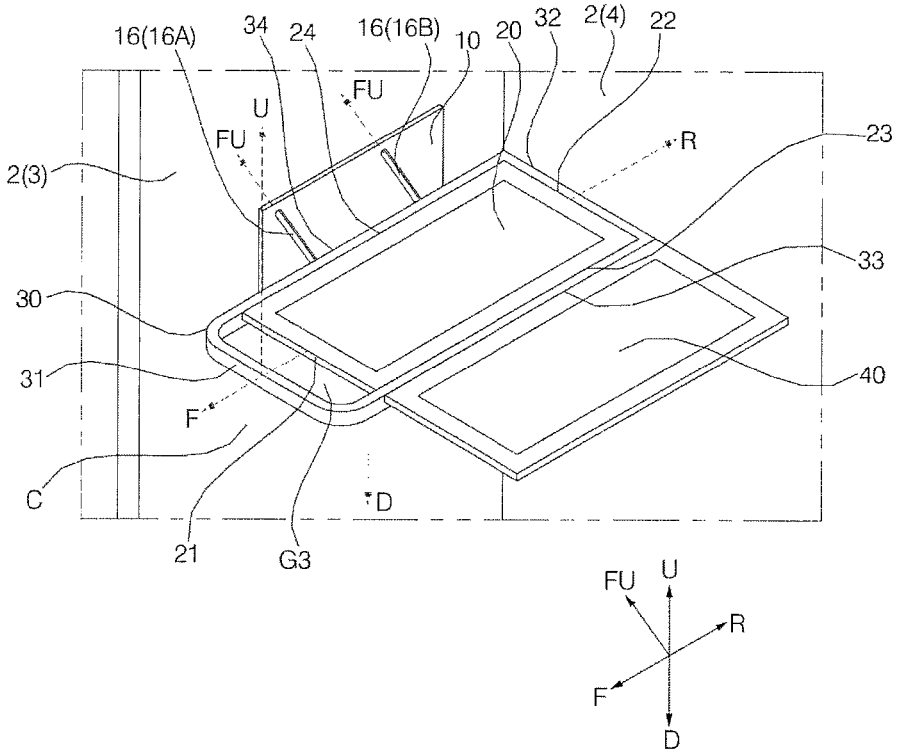
FIG. 1 is a perspective view of an interior of an example refrigerator.
Figure 2:
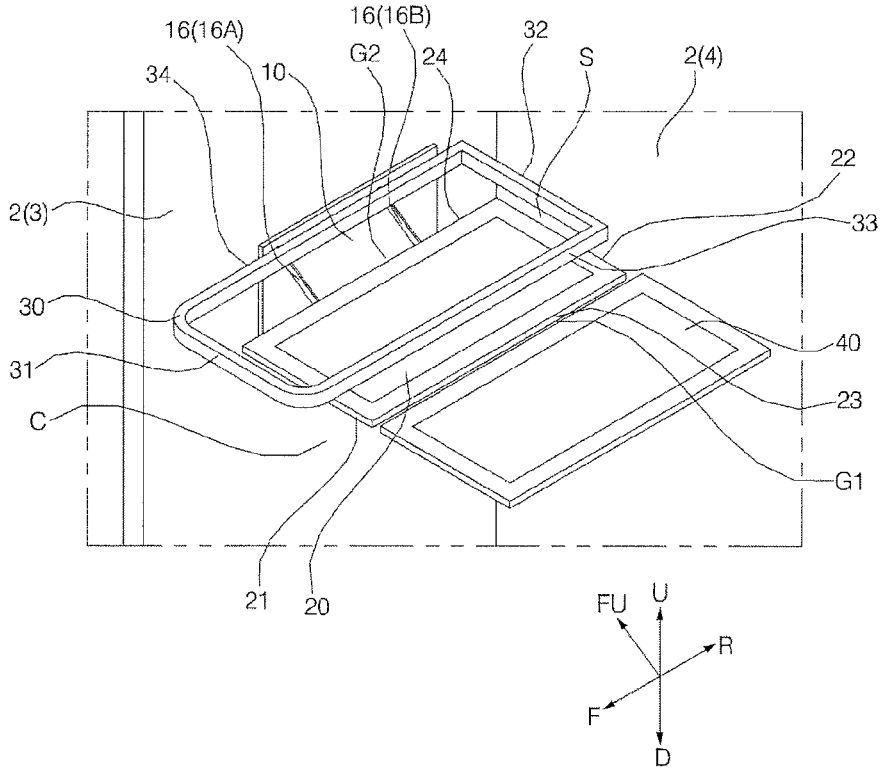
FIG. 2 is a perspective view of an example guard being moved upward.
Figure 3:
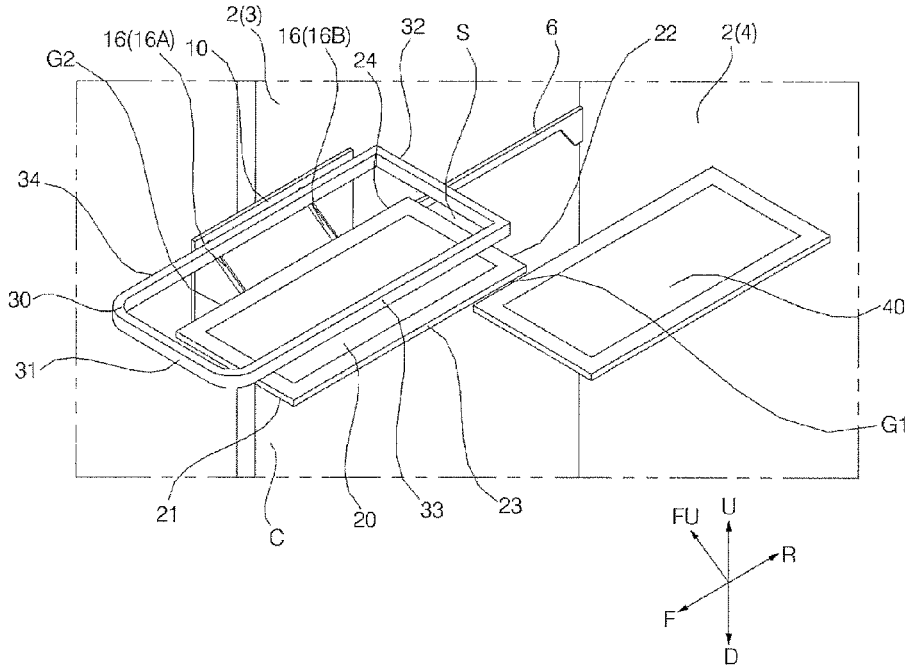
FIG. 3 is a perspective view of an example guard being moved forward.

FIG. 1 illustrates an interior of an example refrigerator. FIGS. 2 and 3 illustrate example guards. FIGS. 4-8 illustrate example guards and example shelves.

As shown in FIGS. 1 to 8, the refrigerator includes a movable body 10 disposed in an inner case 2, a shelf 20 connected to the movable body 10 via a connection member 18, and a guard 30 configured to surround the edge of the shelf 20, the guard 30 having a size greater than the size of the shelf 20. The refrigerator may further include another shelf 40 located at the side of the shelf 20.

The inner case 2 defines a storage compartment C, such as a freezing compartment or a refrigerating compartment, therein. When a door, which is configured to open and close the storage compartment C, is opened, the interior of the storage compartment C may be exposed to the outside. The inner case 2 includes a side plate 3, which constitutes a left side plate or a right side plate, and a rear plate 4, which is perpendicular to the side plate 3.

A movable body guide 6, which is configured to guide the movement of the movable body 10, is mounted in the inner case 2. The movable body guide 6 is disposed in the inner case 6 such that the movable body guide 6 extends in forward and rearward directions to guide the sliding movement of the movable body in the forward and rearward directions. The movable body 10 may be guided by the movable body guide 6 such that the movable body 10 can be moved in forward and rearward directions. The movable body guide 6 is located at the side of the side plate 3. The movable body guide 6 is disposed at the front of the rear plate 4. The movable body guide 6 may be manufactured separately from the inner case 2, and may then be coupled to the inner case 2 using fastening members, such as screws or hooks. Alternatively, the movable body guide 6 may be integrally formed at the inner case 2. The movable body guide 6 may be formed in the inner case 2 such that the movable body guide 6 is concave, or may be formed on the inner case 2 such that the movable body guide 6 protrudes toward the storage compartment C.

The movable body 10 is guided by the movable body guide 6 such that the movable body 10 is moved along the movable body guide 6 in a longitudinal direction of the movable body guide 6. A contact part 7, which is configured to contact the movable body guide 6, is integrally formed at the movable body 10 such that the movable body 10 can be moved along the movable body guide 6. A roller may be rotatably mounted to at least one selected from between the movable body 10 and the movable body guide 6 such that the movable body 10 can be moved by the roller. In some implementations, the roller may be placed on the movable body guide 6, and, when the movable body 10 is moved in the forward and rearward directions, the roller may be rotated such that the movable body 10 can be moved smoothly.

The movable body 10 is provided with a guide rail 16, along which the movement of the guard 30 is guided. The guard 30 includes a protrusion member 35. The protrusion member 35 is configured to protrude from the guard 30 toward the movable body 10.

The guide rail 16 is configured such that the sliding movement of the protrusion member 35 is guided along the guide rail 16. The guide rail 16 is formed in the movable body 10 such that the guide rail 16 is concave. The guide rail 16 is configured as a groove that extends in a direction in which the protrusion member 35 is moved. The guide rail 16 may include a pair of ribs formed at the movable body 10 in a protruding fashion. The guide rail 16 is configured such that opposite ends of the guide rail 16 are closed in the direction in which the protrusion member 35 is moved. The opposite ends of the guide rail 16 may function as stoppers, by which the protrusion member 35 is caught.

In some implementations, the guide rail 16 extends in an inclined direction FU facing the front upper side. The guide rail 16 is formed at the movable body 10 such that the guide rail 16 extends in a direction facing the front upper side of the storage compartment C. The guard 30 may be moved upward along the guide rail 16 while being moved forward, or may be moved downward along the guide rail 16 while being moved rearward.

In some implementations, the guide rail 16 extends in upward and downward directions. The guide rail 16 is formed at the movable body 10 such that the guide rail 16 extends in a direction facing the upper side of the storage compartment C. In some implementations, the guard 30 may be moved upward and downward along the guide rail 16.

In some implementations, the guide rail 16 extends in a round shape. The guide rail 16 may be rounded such that the guide rail 16 is convex toward the upper side between the front end and the rear end of the guide rail 16. In some implementations, the guard 30 may be moved upward along the guide rail 16, which is formed to have a curved shape, while being moved forward, or may be moved downward along the guide rail 16 along a curved path while being moved rearward.

The guide rail 16, which is provided at the movable body 10, includes a plurality of guide rail parts 16A and 16B. The guide rail parts 16A and 16B are spaced apart from each other in the forward and rearward directions. The guide rail parts 16A and 16B include a front guide rail part 16A and a rear guide rail part 16B, which is located at the rear of the front guide rail part 16A.

The shelf 20 is configured to be movable together with the movable body 10. The shelf 20 is located at the side of the shelf 40 such that the shelf 20 can be moved rearward and forward. As shown in FIGS. 1 and 2, the shelf 20 may be moved rearward such that the shelf 20 is located at the side of the shelf 40. As shown in FIG. 3, the shelf 20 may be moved forward toward the front of the storage compartment C.

A gap G1, into which the guard 30 is inserted, is formed between the shelf 20, which is connected to the movable body 10, and the shelf 40. The gap G1 is formed between one side end of the shelf 20 and a corresponding side of the shelf 40 such that a portion of the guard 30 is inserted into the gap G1. The shelf 20 is configured such that a face 23 of the shelf 20 that faces the shelf 40 is spaced apart from the shelf 40 and such that the shelf 20 is connected to the movable body 10. A portion of the guard 30 may be introduced between the shelf 20 and the shelf 40 to fill the gap G1 formed between the shelf 20 and the shelf 40.

A gap G2, into which a portion of the guard 30 is inserted, is formed between the other side end of the shelf 20 and the movable body 10. The shelf 20 is configured such that a face 24 of the shelf 20 that faces the movable body 10 is spaced apart from the movable body 10. A portion of the guard 30 may be introduced between the shelf 20 and the movable body 10 to fill the gap G2 formed between the shelf 20 and the movable body 10.

The connection member 18 is formed on at least one selected from between the shelf 20 and the movable body 10 in a protruding fashion. The connection member 18 protrudes from a lateral surface of the shelf 20 toward the movable body 10. The connection member 18 protrudes from the lower surface thereof, and the side end of the connection member 18 is connected to a face of the movable body 10 that faces the shelf 20. The connection member 18 may include a plurality of connection member parts 18A and 18B. The connection member parts 18A and 18B are arranged between the movable body 10 and the shelf 20. The connection member parts 18A and 18B are spaced apart from each other in the forward and rearward directions. The connection member parts 18A and 18B include a front connection member part 18A and a rear connection member part 18B, which is located at the rear of the front connection member part 18A.

The guard 30 is formed to surround the front, the rear, the left, and the right of the shelf 20. The guard 30 may be formed to have a quadrangular shape. The guard 30 includes a front end part 31, a rear end part 32, a left end part 33, and a right end part 34. A space S, the size of which is greater than that of the shelf 20, is defined by the front end part 31, the rear end part 32, the left end part 33, and the right end part 34.

The front end part 31 is configured such that the front end part 31 faces the front end 21 of the shelf 20 during the downward movement of the guard 30 and such that the front end part 31 is spaced apart from the front end 21 of the shelf 20. A gap G3 is formed between the front end part 31 and the front end 21 of the shelf 20. The gap G3, which is formed between the front end 21 of the shelf 20 and the rear surface of the front end part 31, may be a space, into which a hand of a user may be inserted, and the front end part 31 of the guard 30 may be a handle that the user may hold.

The rear end part 32 is configured such that the rear end part 32 faces the rear end 22 of the shelf 20 during the downward movement of the guard 30 and such that the rear end part 32 is located between the rear end of the shelf 20 and the rear plate 4 of the inner case 2.

One selected from between the left end part 33 and the right end part 34, at which the shelf 40 is disposed, may have a thickness such that it can be inserted into the gap G1 between the shelf 20 and the shelf 40, and may be located between the shelf 40 and the face 23 of the shelf 20 that faces the shelf 40.

The other selected from between the left end part 33 and the right end part 34 may have a thickness such that it can be inserted into the gap G2 between the shelf 20 and the movable body 10, and may be located between the face 24 of the shelf 20 that faces the movable body 10 and the movable body 10.

As described above, the protrusion member 35, which is guided along the guide rail 16, is provided at the guard 30. The protrusion member 35 of the guard 30 may be moved upward along the guide rail 16 in the inclined direction FU facing the front upper side, or may be moved downward along the guide rail 16 in an inclined direction facing the rear lower side. The number of protrusion members 35 may correspond to the number of guide rails 16. In a case in which the guide rail 16 includes the front guide rail part 16A and the rear guide rail part 16B, the protrusion member 35 may include a front protrusion member part 35A, which is guided along the front guide rail part 16A, and a rear protrusion member part 35B, which is guided along the rear guide rail part 16B. The protrusion member 35 is formed at the side end of the guard 30 in a protruding fashion. The protrusion member 35 is formed at the side end of the guard 30 facing the movable body 10 in a protruding fashion.

The frictional force F1 between the protrusion member 35 and the guide rail 16 may be lower than the frictional force F2 between the movable body 10 and the movable body guide 6. The contact area between the protrusion member 35 and the guide rail 16 may be smaller than the contact area between the movable body 10 and the movable body guide 6.

When the user pulls the guard 30 while holding the front end part 31 of the guard 30, it may be necessary to prevent the sliding movement of the movable body 10 along the movable body guide 6 in a forward direction F or to minimize the sliding movement of the movable body 10 along the movable body guide 6 in the forward direction F.

The sliding movement of the protrusion member 35 may be guided along the guide rail 16 before the sliding movement of the movable body 10 along the movable body guide 6, and the guard 30 may be moved upward in the inclined direction FU facing the front upper side before the forward movement of the shelf 20 in the forward direction F.

When the user pulls the guard 30 while holding the front end part 31 of the guard 30, the protrusion member 35 may reach the upper end of the guide rail 16, and may be caught by the upper end of the guide rail 16. At this time, the protrusion member 35 may pull the guide rail 16 in the forward direction F. In some implementations, the movable body 10 may be moved forward in the forward direction F together with the guard 30, and the shelf 20, which is connected to the movable body 10 via the connection member 18, may be moved forward together with the movable body 10.

Hereinafter, the operation of an example refrigerator will be described in detail.

First, the user may pull the guard 30 in the forward direction F while holding the front end part 31 of the guard 30, may lift the guard 30 upward in the inclined direction FU facing the front upper side, or may lift the guard 30 upward in an upward direction U. In some implementations, the protrusion member 35, which is formed at the guard 30, is guided by the guide rail 16 such that the protrusion member 35 is slid forward and upward along the guide rail 16. At this time, the guard 30 is moved forward and upward along the guide rail 16 in the inclined direction FU facing the front upper side.

Figure 5:
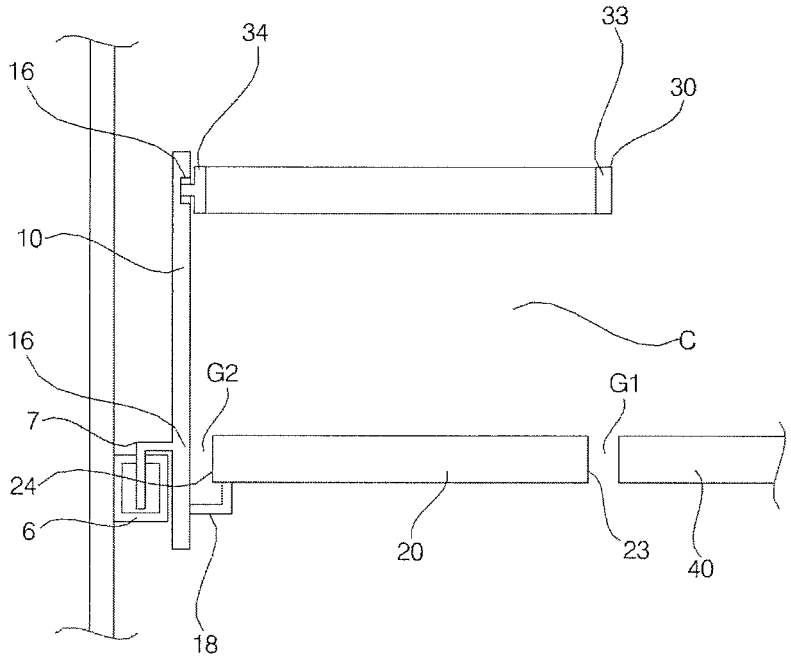
FIG. 5 is a sectional view an example guard being moved upward and an example shelf being moved rearward in a refrigerator.
Figure 7:
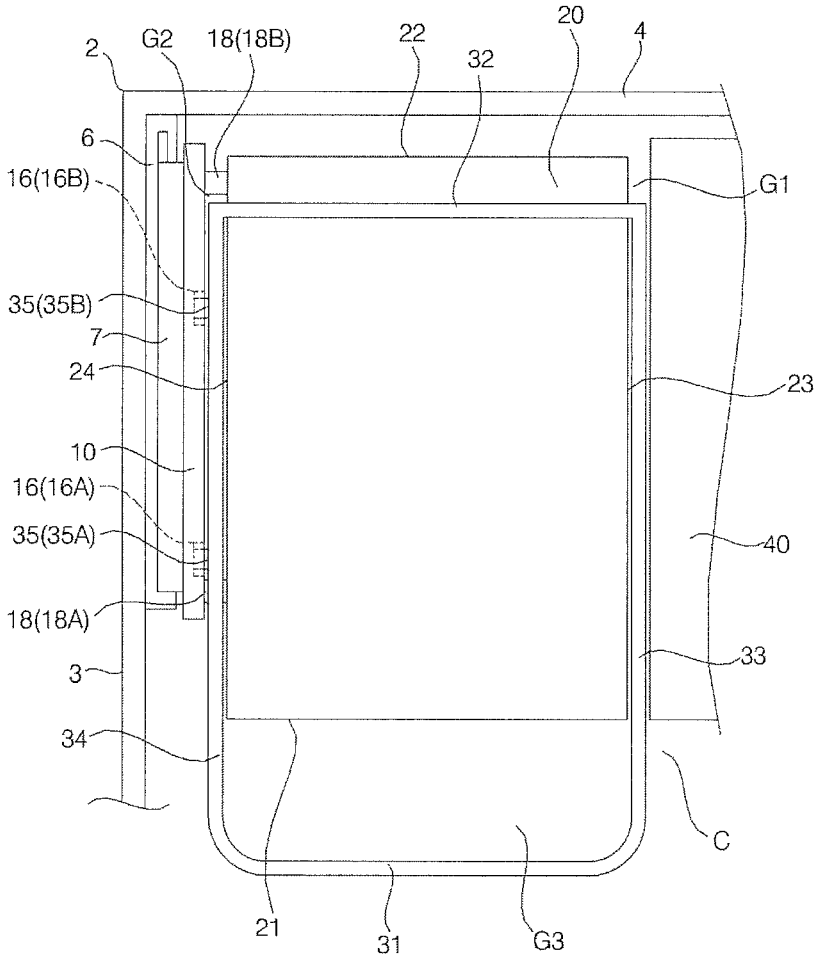
FIG. 7 is a plan view of an example guard being moved upward and an example shelf being moved rearward in a refrigerator.

As the front end part 31, the rear end part 32, the left end part 33, and the right end part 34 of the guard 30 are moved forward and upward all together, the guard 30 becomes gradually spaced apart from the shelf 20. As shown in FIGS. 2, 5, and 7, the guard 30 is moved to the upper side of the shelf 20 such that the guard 30 is spaced apart from the shelf 20. When the protrusion member 35, which is formed at the guard 30, reaches the upper end of the guide rail 16 and is caught by the upper end of the guide rail 16, the upward movement of the guard 30 is completed.

While the guard 30 is being moved upward, or after the guard 30 has been moved upward, the user may pull the guard 30 or the shelf 20 in the forward direction F while holding the guard 30 or the shelf 20. At this time, the shelf 20 is moved in the forward direction F together with the movable body 10.

When the guard 30 leads the movable body 10 in the forward direction, the shelf 20 is moved forward together with the movable body 10. When the shelf 20 is pulled in the forward direction F, the movable body 10 is moved forward together with the shelf 20. At this time, the guard 30 is moved forward along the guide rail 16 together with the movable body 10.

During the forward movement of the shelf 20, the guard 30 may be spaced apart from the shelf 20 around the upper side of the shelf 20. In some implementations, the guard 30 may maximally prevent articles, such as food, placed on the shelf 20 from slipping toward the perimeter of the shelf 20 or tipping over on the shelf 20 as the result of movement of the shelf 20.

The user may remove articles, such as food, from the shelf 20 through the guard 30, or may place articles, such as food, on the shelf 20 through the guard 30.

Figure 8:
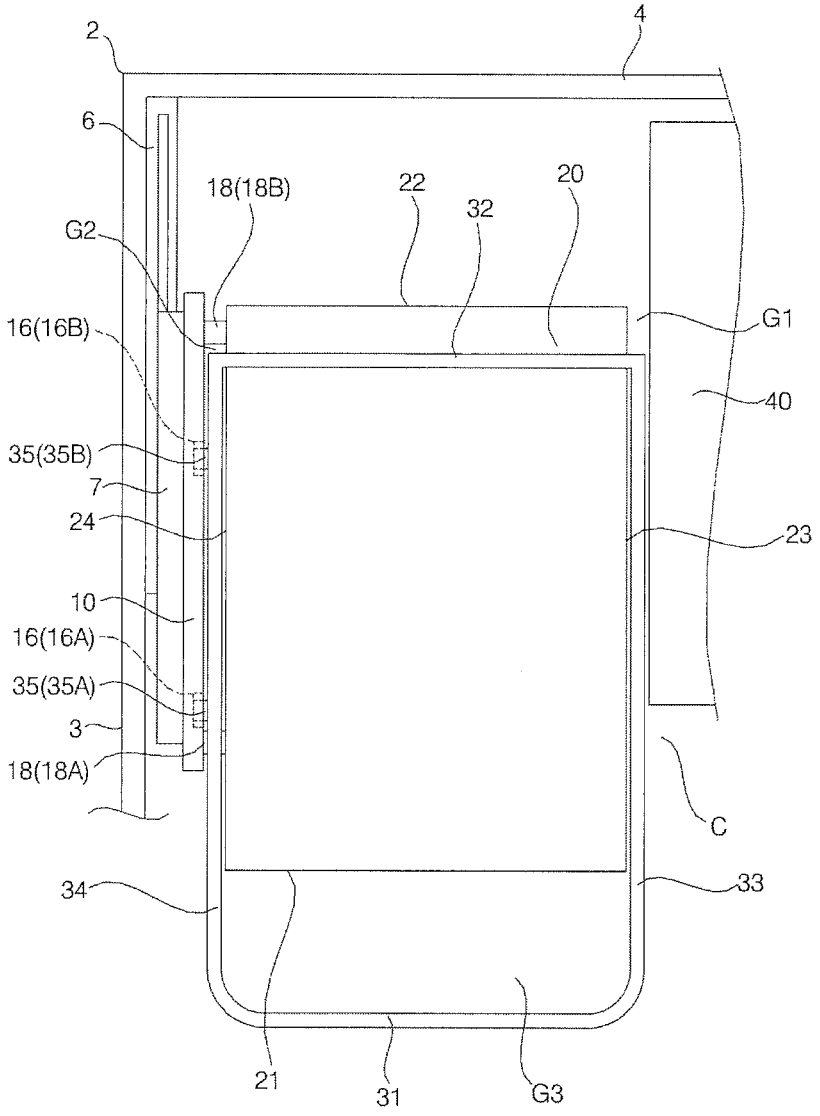
FIG. 8 is a plan view of an example guard being moved upward and an example shelf being moved forward in a refrigerator.

As shown in FIGS. 3 and 8, the user may push the shelf 20 in a rearward direction R in a state in which the guard 30 has been moved upward in the inclined direction FU facing the front upper side and in which the shelf 20 has been moved forward in the forward direction F.

The shelf 20 is moved rearward together with the movable body 10, and the guard 30 is moved rearward together with the movable body 10 in a state in which the guard 30 is located at the upper side of the shelf 20. In some implementations, the guard 30 may be spaced apart from the shelf 20 around the upper side of the shelf 20, and the guard 30 may maximally prevent articles, such as food, placed on the shelf 20 from slipping toward the perimeter of the shelf 20 or tipping over on the shelf 20 as the result of movement of the shelf 20.

As shown in FIGS. 2, 5, and 7, the shelf 20 may be moved rearward such that the shelf 20 is located at the side of the shelf 40, and the user may push the guard 30 in the rearward direction R, in the inclined direction facing the rear lower side, or in a downward direction D, holding the guard 30. The protrusion member 35, which is formed at the guard 30, is guided by the guide rail 16 such that the protrusion member 35 is slid downward and rearward along the guide rail 16. At this time, the guard 30 is moved rearward and downward along the guide rail 16 in the inclined direction facing the rear lower side. When the protrusion member 35, which is formed at the guard 30, is caught by the lower end of the guide rail 16, the downward movement of the guard 30 is completed.

Figure 4:
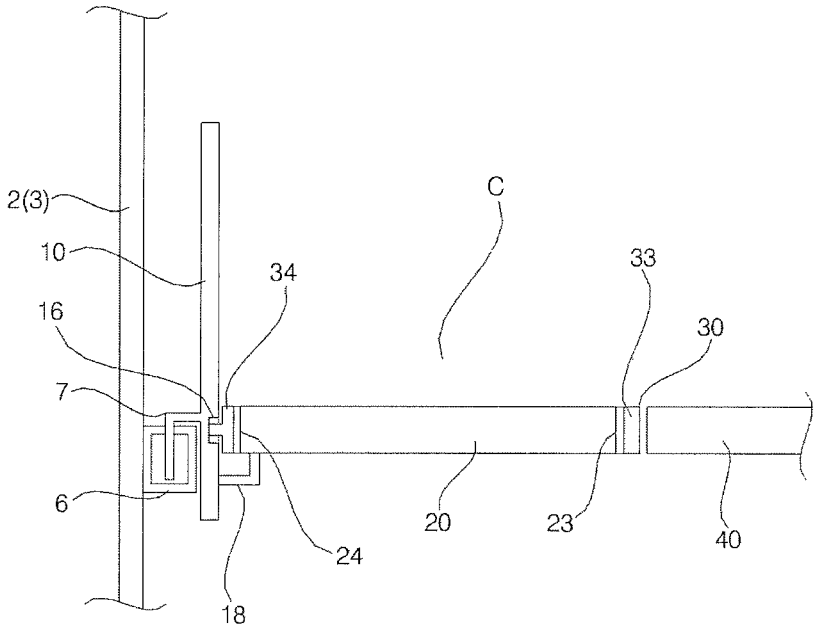
FIG. 4 is a sectional view of an example guard being moved downward and an example shelf being moved rearward in a refrigerator.
Figure 6:
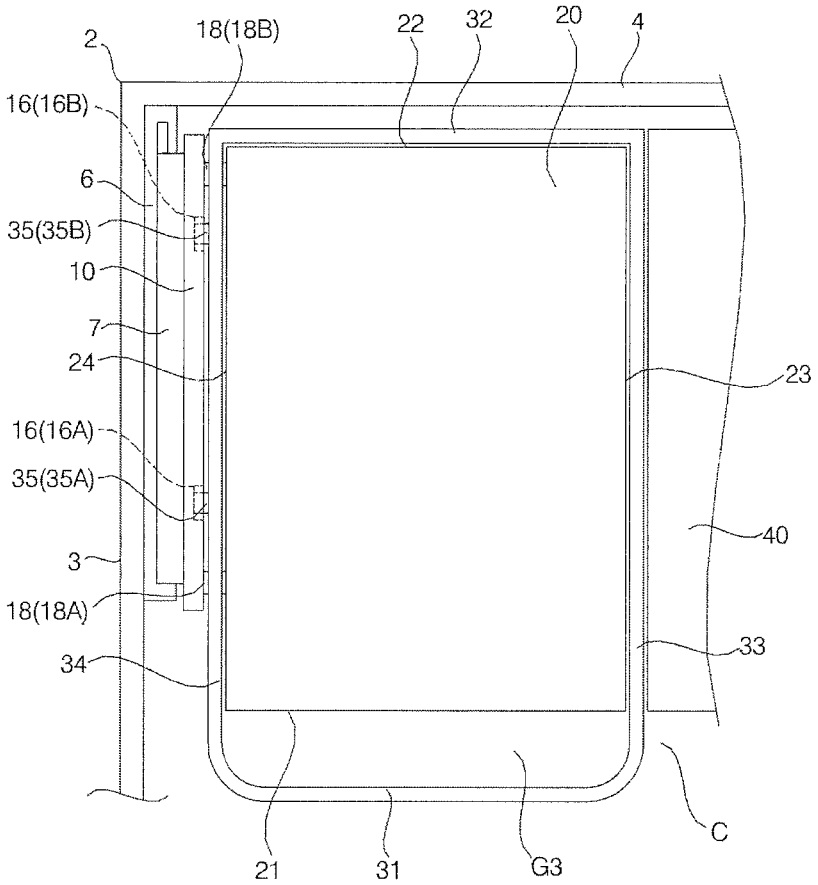
FIG. 6 is a plan view of an example guard being moved downward and an example shelf being moved rearward in a refrigerator.

When the guard 30 has been moved rearward and downward along the guide rail 16, as shown in FIGS. 1, 4, and 6, the guard 30 surrounds the edge of the shelf 20. When the guard 30 is moved to a position at which the guard 30 surrounds the edge of the shelf 20, the left end part 33 of the guard 30 is inserted between the shelf 20 and the shelf 40, and the right end part 34 of the guard 30 is inserted between the movable body 10 and the shelf 20, with the result that the gap between the shelf 20 and the shelf 40 and the gap between the movable body 10 and the shelf 20 may be minimized. When the guard 30 is moved downward to a position at which the guard 30 surrounds the edge of the shelf 20, the guard 30 may perform the same function as the shelf 20 and the shelf 40. That is, food may be placed on the guard 30.

Figure 9:
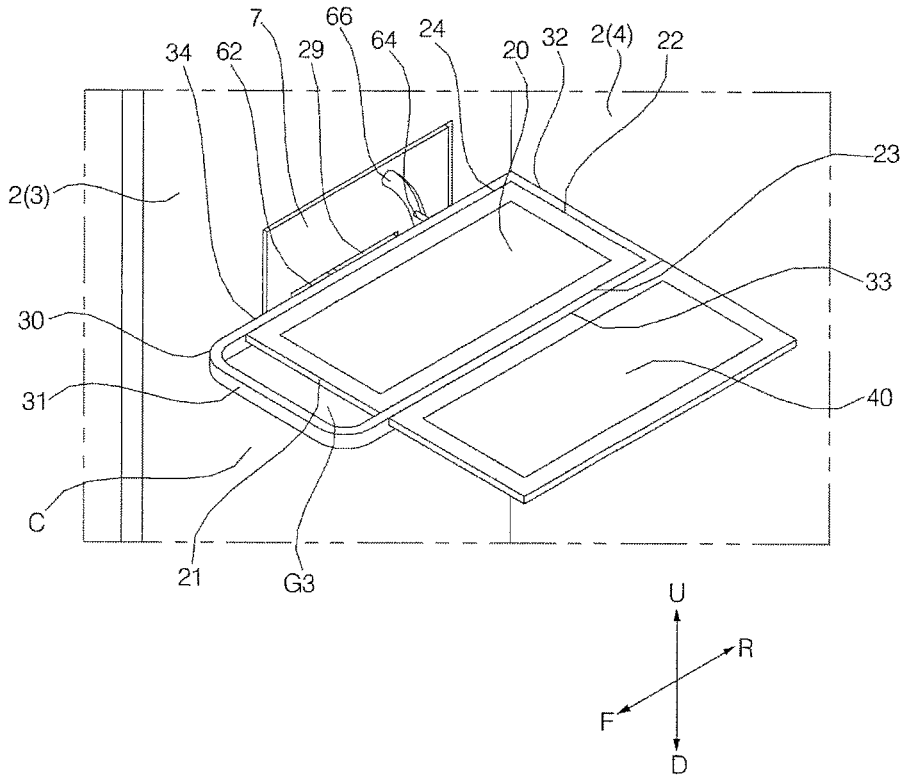
FIG. 9 is a perspective view of an interior of an example refrigerator.
Figure 10:
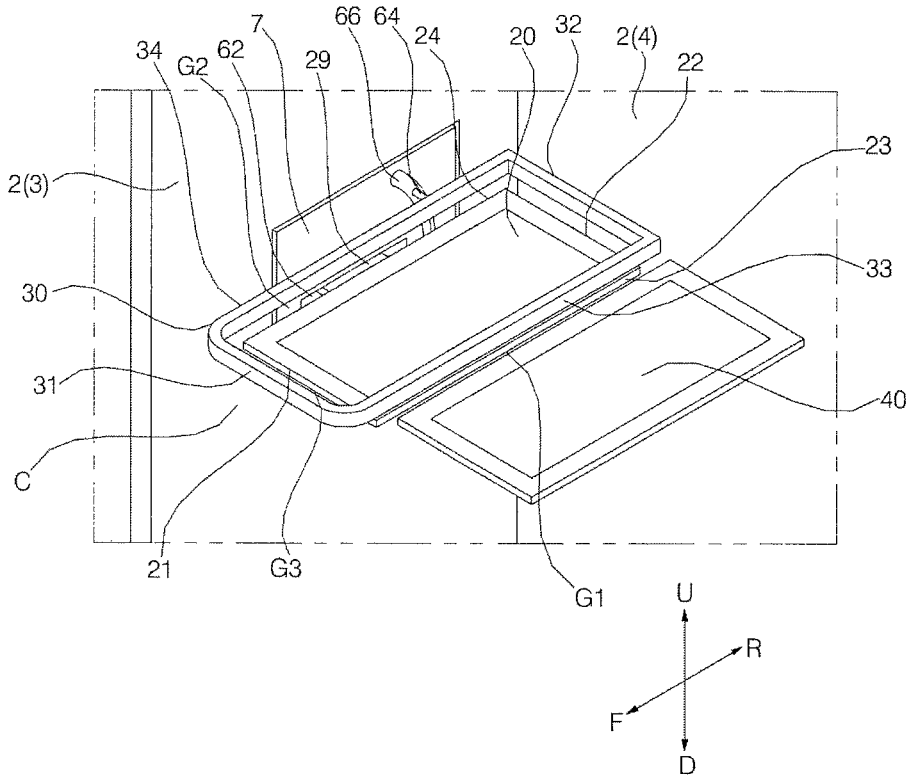
FIG. 10 is a perspective view of a guard shown in FIG. 9 being moved upward and a shelf shown in FIG. 9 being moved forward.
Figure 11:
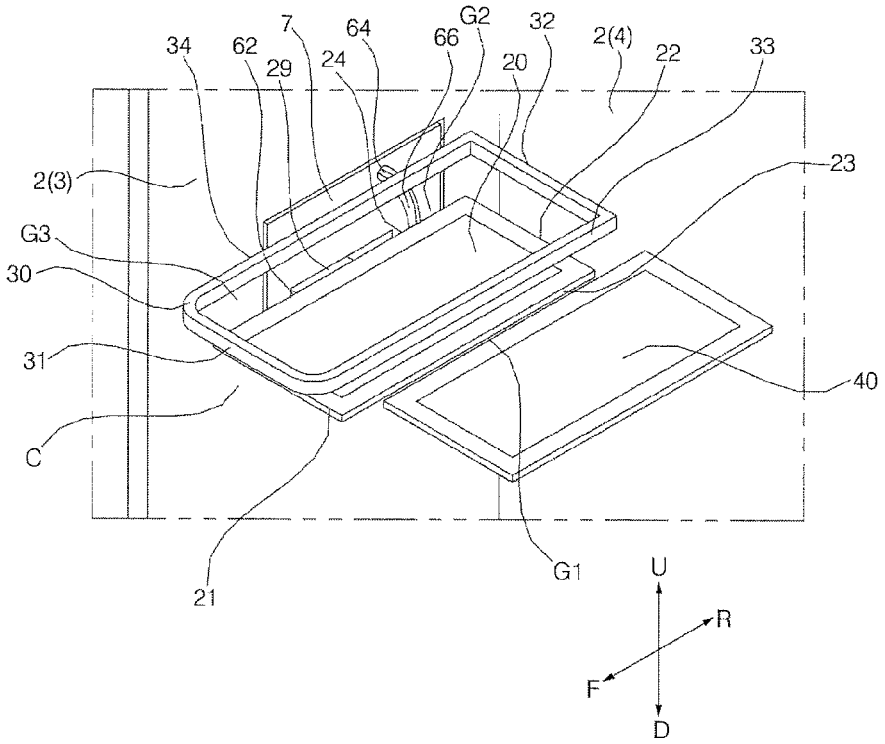
FIG. 11 is a perspective view of a guard shown in FIG. 9 being moved upward and a shelf shown in FIG. 9 being moved forward.
Figure 12:
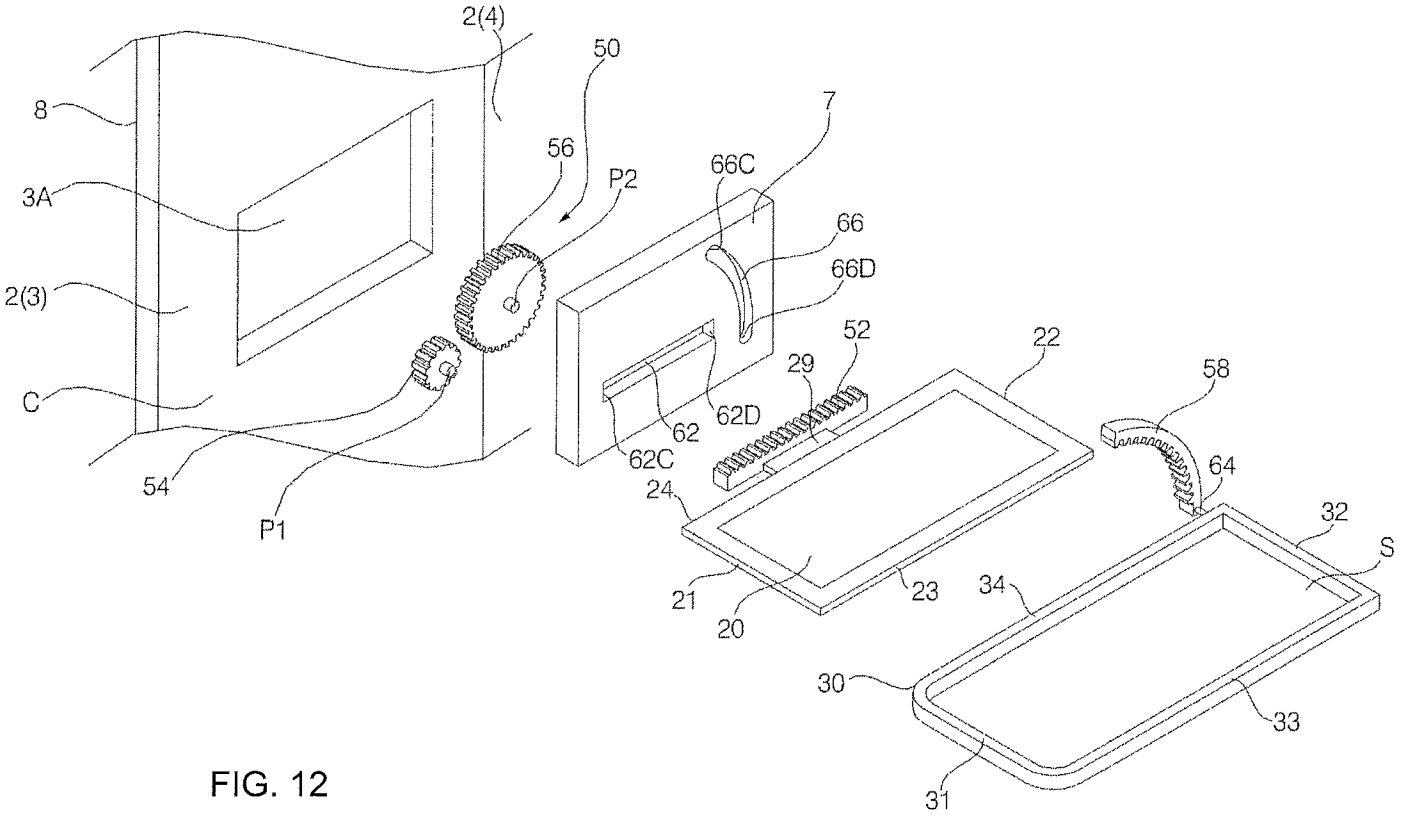
FIG. 12 is an exploded perspective view of example main parts of a refrigerator.
Figure 14:
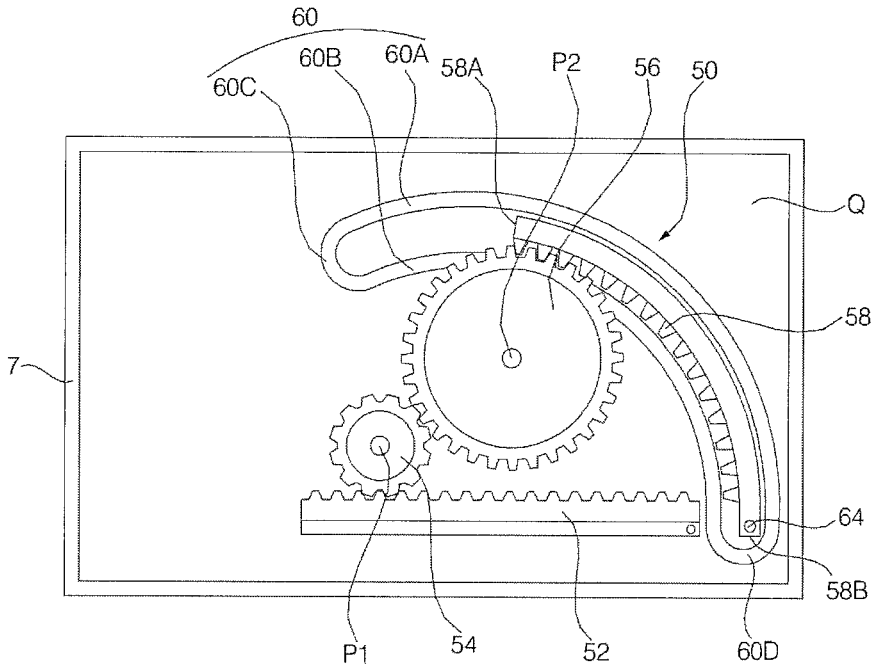
FIG. 14 is a side view of an example interlocking mechanism of a refrigerator.
Figure 15:
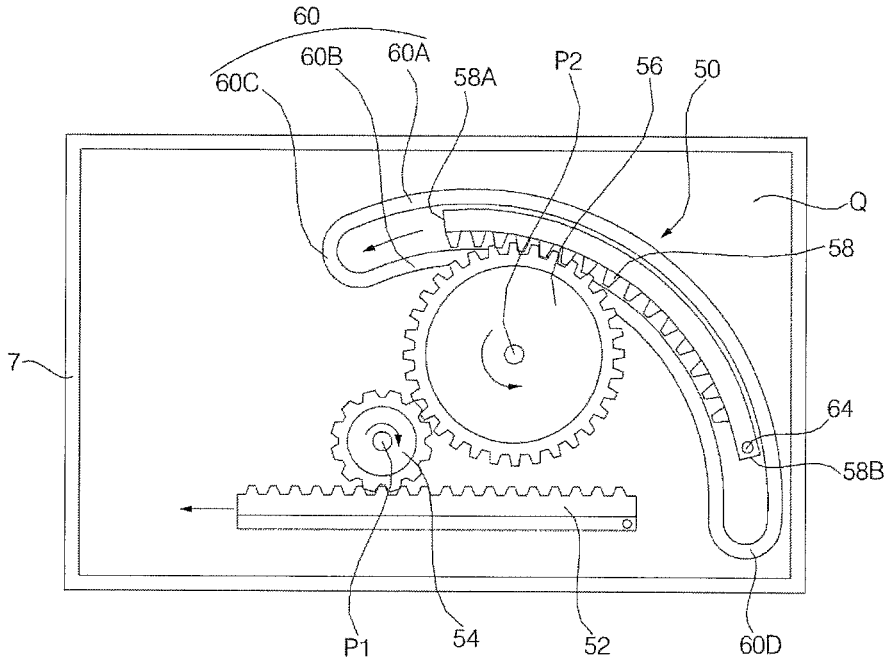
FIG. 15 is a side view of an example interlocking mechanism when a guard shown in FIG. 9 is being moved upward and a shelf shown in FIG. 9 is being moved forward.
Figure 16:
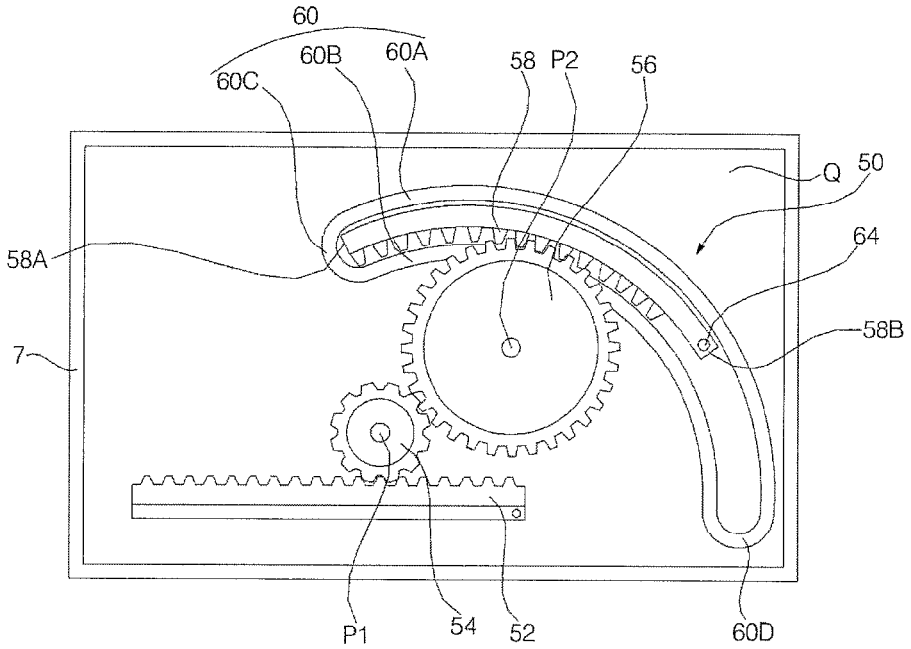
FIG. 16 is a side view of an example interlocking mechanism when a guard shown in FIG. 10 has been moved upward and a shelf shown in FIG. 10 has been moved forward.

FIG. 9 illustrates an interior of an example refrigerator. FIGS. 10 and 11 illustrate example guards and example shelves. FIG. 12 illustrates example main parts of a refrigerator. FIG. illustrates an example refrigerator. FIGS. 14-16 illustrate example interlocking mechanisms of refrigerators.

As shown in FIGS. 9 to 16, the refrigerator includes a shelf 20 movably disposed in an inner case 2, a guard 30 configured to surround the edge of the shelf 20, the guard 30 having a size greater than the size of the shelf 20, and an interlocking mechanism 50 connected to the shelf 20 and the guard 30 for operating one of the shelf 20 and the guard 30 when the other of the shelf 20 and the guard 30 is operated.

The interlocking mechanism 50 is connected to the shelf 20 and the guard 30 in order to interlock the forward and rearward movement of the shelf 20 with the upward and downward movement of the guard 30, respectively. The interlocking mechanism 50 may be configured to have three interlocking examples, which will be described in detail hereinafter. In a first interlocking example, the interlocking mechanism 50 may be connected to the shelf 20 and the guard 30 in order to move the guard 30 upward when the shelf 20 is moved forward. In a second interlocking example, the interlocking mechanism 50 may be connected to the shelf 20 and the guard 30 in order to move the shelf 20 forward when the guard 30 is moved upward. In a third interlocking example, the interlocking mechanism 50 may be connected to the shelf 20 and the guard 30 in order to move the guard 30 upward when the shelf 20 is moved forward and to move the shelf 20 forward when the guard 30 is moved upward.

The interlocking mechanism 50 may operate the shelf 20 and the guard 30 simultaneously. The interlocking mechanism 50 may include a plurality of gears. The gears of the interlocking mechanism 50 may be sequentially engaged with each other.

The interlocking mechanism 50 will be described in detail with reference to FIGS. 12 to 16. The interlocking mechanism 50 includes a first gear 52 formed at the shelf 20 in a state in which the first gear 52 extends in forward and rearward directions, a second gear 54, which is engaged with the first gear 52, a third gear 56, which is engaged with the second gear 54, and a fourth gear 58, which is connected to the guard 30 in a state in which the fourth gear 58 is engaged with the third gear 56.

The interlocking mechanism 50, which is constituted by the first gear 52, the second gear 54, the third gear 56, and the fourth gear 58, is configured such that the fourth gear 58 is moved along a predetermined path when the first gear 52 is moved in the forward and rearward directions and such that the first gear 52 is moved in the forward and rearward directions when the fourth gear 58 is moved.

In some implementations, the front end part 31 of the guard 30 is spaced apart from the front end 21 of the shelf 20, and a gap G3 is formed between the front end part 31 of the guard 30 and the front end 21 of the shelf 20.

In some implementations, the refrigerator may further include another shelf 40 located at the side of the shelf 20.

The first gear 52 is configured as a rack that extends in a direction parallel to a direction in which the shelf 20 is moved. The first gear 52 is located at the side of the shelf 20 in a state in which the first gear 52 extends in the forward and rearward directions.

When the first gear 52 is moved in the forward and rearward directions, the second gear 54 is rotated about a pivot P1 in a state in which the second gear 54 is engaged with the first gear 52. When the third gear 56 is rotated, the second gear 54 is rotated about the pivot P1 in a state in which the second gear 54 is engaged with the third gear 56. When the first gear 52 is moved in the forward and rearward directions, the second gear 54 is rotated so as to rotate the third gear 56. When the third gear 56 is rotated, the second gear 54 is rotated together with the third gear 56 so as to move the first gear 52 in the forward and rearward directions.

The second gear 54 is disposed on the first gear 52. The second gear 54 is rotated about the pivot P1 on the first gear 52. The second gear 54 is disposed between the first gear 52 and the third gear 56. The second gear 54 is rotated about the pivot P1 between the first gear 52 and the third gear 56 in a state in which the second gear 54 is interlocked with the first gear 52 and the third gear 56.

When the second gear 54 is rotated, the third gear 56 is rotated about a pivot P2 by the second gear 54. When the fourth gear 58 is moved, the third gear 56 is rotated about the pivot P2. When the second gear 54 is rotated, the third gear 56 is rotated to move the fourth gear 58. When the fourth gear 58 is moved, the third gear 56 is rotated to rotate the second gear 54.

The third gear 56 and the second gear 54 are spur gears. The third gear 56 has a diameter greater than the diameter of the second gear 54. The number of gear teeth constituting the third gear 56 is greater than the number of gear teeth constituting the second gear 54.

The third gear 56 is disposed between the first gear 52 and the fourth gear 58. The third gear 56 may be spaced apart from the first gear 52, and may be located higher than the first gear 52. The third gear 56 may be located above the first gear 52 such that the third gear 56 is spaced apart from the first gear 52.

When the third gear 56 is rotated, the fourth gear 58 is moved along the outer circumference of the third gear 56. The fourth gear 58 is moved together with the guard 30. The guard 30 and the fourth gear 58 are moved along the same path.

In some implementations, the refrigerator further includes a gear box 7, which is disposed in the inner case 2. The gear box 7 is provided with a gear receiving space Q, in which the interlocking mechanism 50 is received. The first gear 52, the second gear 54, the third gear 56, and the fourth gear 58 are received in the gear receiving space Q. The gear box 7 may protect the first gear 52, the second gear 54, the third gear 56, and the fourth gear 58.

In some implementations, the gear box 7 is mounted in the inner case 2 such that at least a portion of the gear box 7 is exposed to a storage compartment C. The gear box 7 is mounted in the inner case 2 such that the gear box 7 protrudes toward the storage compartment C. A gear box receiving recess 3A, into which the gear box 7 is inserted, is formed in the inner case 2. The gear box 7 is received in the gear box receiving recess 3A.

In some implementations, the gear box 7 is mounted outside the inner case 2 such that the gear box 7 is not exposed to the storage compartment C. An insulating material 9 is disposed between an outer case 8 and the inner case 2. The gear box 7 is mounted outside the inner case 2, and the insulating material 9 surrounds the outer surface of the gear box 7.

The first gear 52 is disposed in at least one selected from between the gear box 7 and the inner case 2 such that the sliding movement of the first gear 52 is guided in the forward and rearward directions. The first gear 52 may be moved forward or rearward between the gear box 7 and the inner case 2. At least one selected from between the gear box 7 and the inner case 2 is provided with a first gear guide configured to guide the movement of the first gear 52 in the forward and rearward directions.

A protrusion member 29 is formed at the lateral surface or the lower surface of the shelf 20 in a protruding fashion. The first gear 52 is formed at a portion of the upper surface of the protrusion member 29 such that the first gear 52 extends in the forward and rearward directions. A portion of the protrusion member 29 is located in the gear receiving space Q, and the first gear 52 is formed at the portion of the protrusion member 29 that is located in the gear receiving space Q. The shelf 20 includes a plate-shaped shelf body, which is located in the inner case 2, the protrusion member 29, which protrudes from the shelf body, and the first gear 52, which is formed at a portion of the protrusion member 29.

The second gear 54 and the third gear 56 are rotatably connected to at least one selected from between the gear box 7 and the inner case 2 such that the second gear 54 and the third gear 56 are supported by at least one selected from between the gear box 7 and the inner case 2.

The pivot P1 of the second gear 54 is rotatably connected to at least one selected from between the gear box 7 and the inner case 2. The second gear 54 may be rotated in forward and reverse directions between the gear box 7 and the inner case 2. Here, the forward rotation of the second gear is the rotation of the second gear 54 in a clockwise direction, and the reverse rotation of the second gear 54 is the rotation of the second gear 54 in a counterclockwise direction.

The pivot P2 of the third gear 56 is rotatably connected to at least one selected from between the gear box 7 and the inner case 2. The third gear 56 may be rotated in forward and reverse directions between the gear box 7 and the inner case 2. Here, the forward rotation of the third gear 56 is the rotation of the third gear 56 in the clockwise direction, and the reverse rotation of the third gear 56 is the rotation of the third gear 56 in the counterclockwise direction. The third gear 56 is rotated in a direction opposite to a direction in which the second gear 54 is rotated. That is, when the second gear is rotated in the clockwise direction, the third gear 56 is rotated in the counterclockwise direction, and, when the second gear is rotated in the counterclockwise direction, the third gear 56 is rotated in the clockwise direction.

In some implementations, the refrigerator further includes a guide rail 60 configured to guide the movement of at least one selected from between the guard 30 and the fourth gear 58. The guide rail 60 is formed on at least one selected from between the gear box 7 and the inner case 2.

The guide rail 60 includes a pair of ribs 60A and 60B. The ribs 60A and 60B face each other. The ribs 60A and 60B are formed at the gear box 7 or the inner case 2 such that the ribs 60A and 60B protrude toward the gear receiving space Q. The ribs 60A and 60B guide the movement of the fourth gear 58.

In some implementations, the fourth gear 58 is rounded. The fourth gear 58 is configured as a rack that is rounded to have an arc shape. Gear teeth are formed at the face of the fourth gear 58 that faces the third gear 56. The fourth gear 58 is formed to have an arc shape that is convex upward. The guide rail 60 is rounded such that the guide rail 60 has a shape corresponding to the shape of the fourth gear 58. The guide rail 60 is formed to have an arc shape that is convex upward. The fourth gear 58 is disposed on at least one selected from between the gear box 7 and the inner case 2 such that the fourth gear 58 can be moved along a curved path.

In some implementations, the fourth gear 58 is formed such that gear teeth protrude downward. The upper end gear teeth of the third gear 56 are engaged with the lower end gear teeth of the fourth gear 58. When the guard 30 is located at the lowest position (e.g., the position at which downward movement of the guard 30 is completed), the fourth gear 58 is disposed such that one end 58A of the fourth gear 58 faces forward, and the fourth gear 58 is curved downward toward the other end 58B of the fourth gear 58. When the fourth gear 58 is moved forward, one end 58A of the fourth gear 58 is moved forward and downward. As a result, when the user pulls the guard 30 forward at an initial position at which the other end 58B of the fourth gear 58 is caught by a stopper 60D, the force is applied to the upper end gear teeth of the third gear 56 via the fourth gear 58. Consequently, it is possible to move the guard 30, which is located at the lowest position, using much less force. Particularly, in a case in which the diameter of the third gear 56 is greater than the diameter of the fourth gear 58, much less torque may be applied to the third gear 56.

The guide rail includes one end stopper 60C, which connects one end of the rib 60A and one end of the rib 60B to each other, the other end stopper 60D, which connects the other end of the rib 60A and the other end of the rib 60B to each other. One end 58A of the fourth gear 58 may be stopped and caught by one end stopper 60C. When one end 58A of the fourth gear 58 is caught by one end stopper 60C, the guard 30 and a connection member 64, which connects the fourth gear 58 and the guard 30 to each other, are located at the highest positions. The other end 58B of the fourth gear 58 may be stopped and caught by the other end stopper 60D. When the other end 58B of the fourth gear 58 is caught by the other end stopper 60D, the connection member 64 and the guard 30 are located at the lowest positions. At least one selected from between the inner case 2 and the gear box 7 is provided with a protrusion member through hole 62, through which the protrusion member 29 extends, and a connection member through hole 66, through which the connection member 64 extends.

The protrusion member through hole 62 extends in a direction parallel to the direction in which the shelf 20 is moved. The protrusion member through hole 62 extends in the forward and rearward directions. The protrusion member through hole 62 extends in a direction in which the first gear 52 is moved.

The protrusion member through hole 62 includes one end stopper 62C and the other end stopper 62D. The protrusion member 29 is configured such that the protrusion member 29 is stopped and caught by one end stopper 62C. When the protrusion member 29 is caught by one end stopper 62C, the protrusion member 29 and the shelf 20 are located at the forefront positions (e.g., the positions at which the forward movements of the protrusion member 29 and the shelf 20 are completed). The protrusion member 29 is configured such that the protrusion member 29 is stopped and caught by the other end stopper 62D. When the protrusion member 29 is caught by the other end stopper 62D, the protrusion member 29 and the shelf 20 are located at the rearmost positions (e.g., the positions at which the rearward movements of the protrusion member 29 and the shelf 20 are completed).

The connection member 64 is mounted to the side end of the guard 30 in a protruding fashion. The connection member 64 interconnects the side end of the guard 30 and the side end of the fourth gear 58. The connection member 64 is disposed at the other end 58B of the fourth gear 58.

The connection member through hole 66 guides the sliding movement of the connection member 64. The connection member through hole 66 is formed at the side of the fourth gear 58 such that the connection member through hole 66 extends in a direction parallel to the path of the fourth gear 58. The connection member through hole 66 extends along the path of the fourth gear 58. The connection member through hole 66 includes one end stopper 66C and the other end stopper 66D. The connection member 64 is configured such that the connection member 64 is stopped and caught by one end stopper 64C. When the connection member 64 is caught by one end stopper 66C, the connection member 64 and the guard 30 are located at the uppermost positions. The connection member 64 is configured such that the connection member 64 is stopped and caught by the other end stopper 66D. When the connection member 64 is caught by the other end stopper 66D, the connection member 64 and the guard 30 are located at the lowermost positions. The connection member through hole 66 is formed to have the same shape as a portion of the guide rail 60. The connection member through hole 66 is formed to face a portion of the guide rail 60.

In some implementations, in which the gear box 7 is exposed to the storage compartment C, the protrusion member through hole 62 and the connection member through hole 66 are formed through the gear box 7. The protrusion member through hole 62 and the connection member through hole 66 are formed at portions of the gear box 7 that face the inner case 2. In some implementations, in which the gear box 7 is mounted outside the inner case 2, the protrusion member through hole 62 and the connection member through hole 66 are formed through the inner case 2. The protrusion member through hole 62 and the connection member through hole 66 are formed at portions of the inner case 2 that face the gear box 7.

A gap G1, into which the guard 30 is inserted, is formed between the shelf 20, at which the first gear 52 is formed, and the shelf 40. One selected from between one side end and the other side end of the guard 30 may be inserted into the gap G1, which is formed between the shelf 20 and the shelf 40.

A gap G2, into which the guard 30 is inserted, is formed between the shelf 20, at which the first gear 52 is formed, and at least one selected from between the inner case 2 and the gear box 7. The other selected from between one side end and the other side end of the guard 30 may be inserted into the gap G2, which is formed between the shelf 20 and at least one selected from between the inner case 2 and the gear box 7.

In some implementations, in which the protrusion member through hole 62 and the connection member through hole 66 are formed in the gear box 7, the gap G2 is formed between the gear box 7 and the shelf 20. In some implementations, the protrusion member through hole 62 and the connection member through hole 66 are formed in the inner case 2, and the gap G2 is formed between the inner case 2 and the shelf 20. One selected from between the left end part 33 and the right end part 34 of the guard 30 may be inserted into the gap G2, which is formed between the shelf 20 and one selected from between the inner case 2 and the gear box 7.

When the shelf 40 is located at the left side of the shelf 20, the left end part 33 of the guard 30 may be inserted into the gap G1, which is formed between the shelf 20 and the shelf 40, and the right end part 34 of the guard 30 may be inserted into the gap G2, which is formed between the shelf 20 and at least one selected from between the inner case 2 and the gear box 7.

When the shelf 40 is located at the right side of the shelf 20, on the other hand, the right end part 34 of the guard 30 may be inserted into the gap G1, which is formed between the shelf 20 and the shelf 40, and the left end part 33 of the guard 30 may be inserted into the gap G2, which is formed between the shelf 20 and at least one selected from between the inner case 2 and the gear box 7.

Hereinafter, the operation of an example refrigerator will be described in detail.

First, the user may pull the guard 30 in the forward direction F while holding the front end part 31 of the guard 30, may lift the guard 30 upward in the inclined direction FU facing the front upper side, or may lift the guard 30 upward in the upward direction U. In some implementations, the guard 30 is moved forward and upward along a curved path, as shown in FIG. 10, and the fourth gear 58, which is connected to the guard 30 via the connection member 64, is moved along the outer circumference of the third gear 56, as shown in FIG. 15.

When the guard 30 and the fourth gear 58 are moved as described above, as shown in FIG. 15, the third gear 56 is rotated in the counterclockwise direction by the fourth gear 58 to rotate the second gear 54, and the second gear 54 is rotated in the clockwise direction to move the first gear 52 forward. When the first gear 52 is moved forward, as shown in FIG. 10, the shelf 20 is moved in the forward direction F together with the first gear 52.

That is, as the user moves the guard 30, the guard 30 becomes gradually spaced apart from the shelf 20, with the result that the guard 30 is located higher than the shelf 20. At the same time, the shelf 20 is moved in the forward direction F.

As the front end part 31, the rear end part 32, the left end part 33, and the right end part 34 of the guard 30 are moved forward and upward, the guard 30 becomes gradually spaced apart from the shelf 20. As shown in FIG. 10, the guard 30 may be moved to the upper side of the shelf 20 such that the guard 30 is spaced apart from the shelf 20.

When the connection member 64 is located at the highest position, as shown in FIGS. 11 and 16, the guard 30 is located at the highest position, as shown in FIG. 11. At this time, the shelf 20 is located at the forefront position, as shown in FIG. 11. The upward movement of the guard 30 and the forward movement of the shelf 20 are completed.

During the upward movement of the guard 30 and the forward movement of the shelf 20, the guard 30 is spaced apart from the shelf 20 around the upper side of the shelf 20. The guard 30 may maximally prevent articles, such as food, placed on the shelf 20 from slipping toward the perimeter of the shelf 20 or tipping over on the shelf 20 as the result of movement of the shelf 20.

The user may remove articles, such as food, from the shelf 20, which has been moved to the forefront position, through the guard 30, or may place articles, such as food, on the shelf 20 through the guard 30.

As shown in FIG. 11, the user may push the shelf 20 in the rearward direction R, may push the guard 30 in the rearward direction R, or may push the guard 30 in the rearward and downward directions or in the downward direction D, in a state in which the guard 30 has been moved to the uppermost position and in which the shelf 20 has been moved to the forefront position in the forward direction F. In some implementations, the shelf 20 is moved in the rearward direction R, the first gear 52 is moved in the rearward direction, the second gear 54 is rotated in the counterclockwise direction, the third gear 56 is rotated in the clockwise direction, and the fourth gear 58 is moved along the outer circumference of the third gear 56. The guard 30 is moved in the rearward and downward directions.

When the connection member 64 is located at the lowermost position, as shown in FIGS. 9 and 14, the guard 30 is located at the lowermost position, as shown in FIG. 9. At this time, the shelf 20 is located at the rearmost position, as shown in FIG. 9. The downward movement of the guard 30 and the rearward movement of the shelf 20 are completed.

Figure 13:
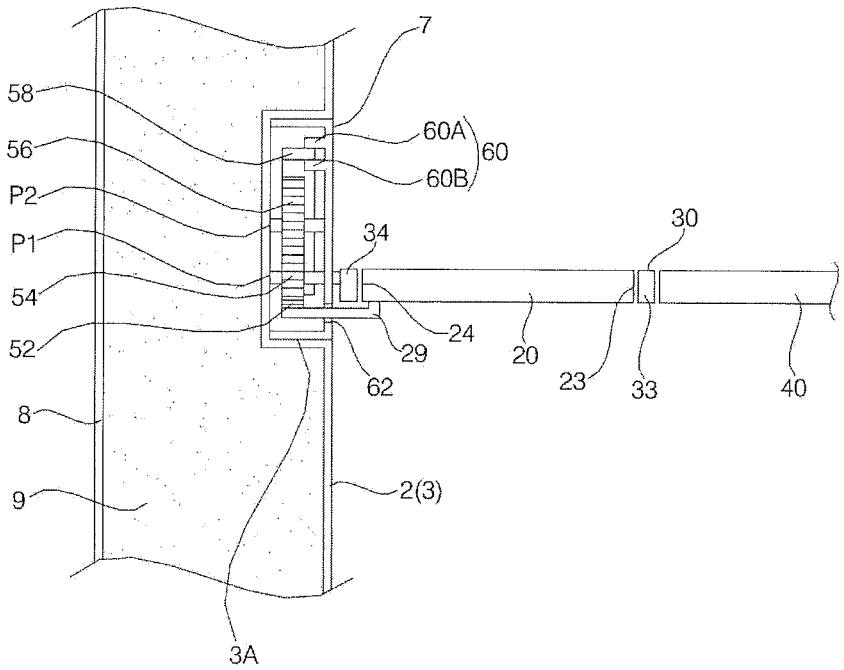
FIG. 13 is a sectional view of an example refrigerator.

When the guard 30 has been moved rearward and downward to the lowermost position, as shown in FIGS. 9 and 13, the guard 30 surrounds the edge of the shelf 20. When the guard 30 is moved to a position at which the guard 30 surrounds the edge of the shelf 20, the left end part 33 of the guard 30 is inserted between the shelf 20 and the shelf 40, the right end part 34 of the guard 30 is inserted between the shelf 20 and one selected from between the inner case 2 and the gear box 7, with the result that gaps, which are formed at opposite sides of the shelf 20, may be minimized. When the guard 30 is moved downward to a position at which the guard 30 surrounds the edge of the shelf 20, the guard 30 may perform the same function as the shelf 20 and the shelf 40. That is, food may be placed on the guard 30.

What is claimed is:

1. A refrigerator comprising:

a shelf that is configured to move towards a front of the refrigerator and a rear of the refrigerator and that is located in a case that defines a storage compartment;

a guard that is configured to prevent articles on the shelf from falling off the shelf; and an interlocking mechanism that is connected to the shelf and the guard, that is configured to move the guard towards a front upper portion of the refrigerator based on the shelf moving towards the front of the refrigerator, and that comprises:

a first gear that is located at the shelf and that extends towards the front of the refrigerator and towards the rear of the refrigerator;

a second gear that is configured to engage the first gear;

a third gear that is configured to engage the second gear; and a fourth gear that is configured to engage the third gear and that is connected to the guard.

2. The refrigerator according to claim 1, wherein the fourth gear is a linear gear.

3. The refrigerator according to claim 2, wherein the fourth gear is curved.

4. The refrigerator according to claim 1, wherein a diameter of the third gear is greater than a diameter of the second gear.

5. The refrigerator according to claim 1, wherein the first gear is a linear gear.

6. The refrigerator according to claim 1, further comprising a guide rail that is configured to guide at least one of the fourth gear or the guard.

7. The refrigerator according to claim 1, further comprising a gear box that is located in the case and that defines a gear receiving space that is configured to receive the first gear, the second gear, the third gear, and the fourth gear.

8. The refrigerator according to claim 7, wherein the second gear and the third gear are rotatably connected to at least one of the gear box or the case.

9. The refrigerator according to claim 7, wherein the shelf and at least one of the gear box or the inner case define a gap that is configured to receive the guard.

10. The refrigerator according to claim 1, wherein a front end part of the guard and a front end of the shelf define a gap.

11. The refrigerator according to claim 1, further comprising:

another shelf that is located at a side of the shelf, wherein the other shelf and the shelf define a gap that is configured to receive the guard.

12. The refrigerator according to claim 1, further comprising:

a movable body that is located in the case and that is connected to the shelf via a connection member, wherein an edge of the shelf and the movable body define a gap that is configured to receive the guard.

13. The refrigerator according to claim 12, wherein:

the guard includes a protrusion member that protrudes towards the movable body, and the movable body includes a guide rail that is configured to guide the protrusion member during sliding.

14. The refrigerator according to claim 13, wherein the guide rail extends in an inclined direction towards a front upper portion of the refrigerator.

15. The refrigerator according to claim 13, wherein:

the guide rail comprises a plurality of guide rail parts that are spaced apart from each other towards the front of the refrigerator and towards the rear of the refrigerator, and the protrusion member comprises a plurality of protrusion member parts that are located at the guard and that are spaced apart from each other towards the front of the refrigerator and towards the rear of the refrigerator.

16. The refrigerator according to claim 15, wherein:

the plurality of guide rail parts includes two guide rail parts, and the plurality of protrusion member parts includes two protrusion member parts.

17. The refrigerator according to claim 15, further comprising:

a movable body guide that is located in the case and that is configured to guide the movable body during sliding towards the front of the refrigerator and towards the rear of the refrigerator, wherein a first contact area that is defined between the protrusion member and the guide rail is smaller than a second contact area that is defined between the movable body and the movable body guide.

18. A refrigerator comprising:

a shelf that is configured to move towards a front of the refrigerator and a rear of the refrigerator and that is located in a case that defines a storage compartment;

a guard that is configured to prevent articles on the shelf from falling off the shelf and that is configured to surround a perimeter of the shelf, wherein a perimeter of the guard is larger than the perimeter of the shelf; and an interlocking mechanism that is connected to the shelf and the guard and that is configured to move the guard towards a front upper portion of the refrigerator based on the shelf moving towards the front of the refrigerator.

* * * * *